US007521865B2

(12) United States Patent
Su et al.

(10) Patent No.: US 7,521,865 B2
(45) Date of Patent: Apr. 21, 2009

(54) PLASMA PANEL HAVING SPACERS AS ELECTRODES

(75) Inventors: Yao-Ching Su, Tao-Yuan (TW); Yih-Jer Lin, Kao-Hsiung (TW)

(73) Assignee: AU Optronics Corp., Hsin-Chu (TW)

( * ) Notice: Subject to any disclaimer, the term of this patent is extended or adjusted under 35 U.S.C. 154(b) by 186 days.

(21) Appl. No.: 10/709,162

(22) Filed: Apr. 19, 2004

(65) Prior Publication Data

US 2004/0245927 A1 Dec. 9, 2004

(30) Foreign Application Priority Data

Jun. 3, 2003 (TW) ..... 92114986 A

(51) Int. Cl.
*H01J 17/49* (2006.01)
*H01J 1/96* (2006.01)

(52) U.S. Cl. ..... 313/582; 313/292; 313/491

(58) Field of Classification Search ..... 313/484–485, 313/491–492, 581–587, 292, 238, 493–494
See application file for complete search history.

(56) References Cited

U.S. PATENT DOCUMENTS 5,420,707 A 5/1995 Miyazaki
5,982,095 A * 11/1999 Jin et al. ..... 313/582
6,034,470 A * 3/2000 Vollkommer et al. ..... 313/485
6,172,461 B1 1/2001 Ha
6,628,066 B1 * 9/2003 Eberhardt et al. ..... 313/495
6,678,020 B2 * 1/2004 Ok et al. ..... 349/61
6,885,151 B2 * 4/2005 Kim et al. ..... 313/631
2005/0082962 A1 * 4/2005 Jang et al. ..... 313/484

FOREIGN PATENT DOCUMENTS

JP 2003157773 A * 5/2003

* cited by examiner

*Primary Examiner*—Karabi Guharay
(74) *Attorney, Agent, or Firm*—Winston Hsu

(57) ABSTRACT

A plasma panel used as a light source of a display panel includes a first substrate having a first surface, a second substrate positioned above the first substrate, a plurality of electrode pairs extending along a first direction on the first surface, and a plurality of conductive spacers. Each of the electrode pairs includes a first electrode and a second electrode. The conductive spacers are formed on the first electrode and the second electrode for performing a discharge of opposed electrodes and supporting the second substrate.

14 Claims, 8 Drawing Sheets

PLASMA PANEL HAVING SPACERS AS ELECTRODES

BACKGROUND OF INVENTION

1. Field of the Invention

The present invention relates to a plasma panel, and more specifically, to a plasma panel capable of enhancing discharge efficiency of discharge gas.

2. Description of the Prior Art

A plasma panel (PP) is one kind of flat light-emitting devices and is similar to a fluorescent lamp using gas discharges to create brilliant irradiation. The luminescent principle of the PP involves the production of ultraviolet (UV) rays by plasma first, followed by irradiation of the UV rays to produce visible light. Since the PP has the advantage of a thin and large-scaled design, and low radiation, it can be used as a backlight of a large-sized liquid crystal display device.

Referring to FIG. 1. FIG. 1 is a perspective view of a prior art plasma panel. As shown in FIG. 1, a plasma panel 10 comprises a front substrate 12, a rear substrate 14 parallel and opposite to the front substrate 12, and a discharge gas sealed between the front substrate 12 and the rear substrate 14. Additionally, the plasma panel 10 further includes a plurality of electrode pairs 16 located on an upper surface of the rear substrate 14, a dielectric layer 22 deposited on the electrode pairs 16, a phosphorous layer 24 formed on a lower surface of the front substrate 12, and a plurality of spacers 26 positioned between the front substrate 12 and the rear substrate 14. Each of the electrode pairs 16 has an electrode 18 and an electrode 20. In addition, each of the spacers 26 is formed on the dielectric layer 22 and is approximately located between the electrode 18 and the electrode 20 for separating the front substrate 12 and the rear substrate 14. Owing to the spacers 26, a gap between the front substrate 12 and the rear substrate 14 is larger than 10 μm for providing a sufficient discharge space for the discharge gas. In general, each of the spacers 26 is an insulating glass ball, and the discharge gas comprises an inert gas such as neon (Ne), xenon (Xe), or a mixture of neon and xenon.

The luminescent principle of the plasma panel 10 is explained as follows for introducing the plasma panel 10 more particularly. Firstly, a discharge voltage is supplied to the electrode 18 and the electrode 20 via a driving circuit (not shown) for inducing a surface discharge between the electrode 18 and the electrode 20 and causing the gas molecules near the electrodes 18 and 20 to become plasma particles. Then, the plasma particles near the electrodes 18 and 20 continue to bombard other gas molecules to form more and more plasma particles. At the same time, the excited atoms within the plasma particles irradiate ultraviolet rays, which are absorbed by the phosphorous layer 24 to produce visible light for making the plasma panel 10 irradiate light beams. However, as the plasma is ignited inside the prior art plasma panel 10, the power consumption is quite high so that the discharge efficiency is reduced and a value of the plasma panel 10 is lowered. As a result, it is an important issue to improve the discharge efficiency of the plasma panel 10.

SUMMARY OF INVENTION

It is therefore one object of the present invention to provide a plasma panel capable of enhancing the discharge efficiency of a discharge gas to solve the above-mentioned problem.

According to the present invention, a plasma panel used as a light source of a display panel is provided. The plasma panel includes a first substrate having a first surface, a second substrate positioned above the first substrate, a plurality of electrode pairs extending along a first direction on the first surface, and a plurality of conductive spacers. Each of the electrode pairs includes a first electrode and a second electrode. The conductive spacers are formed on the first electrode and the second electrode for performing a discharge of opposed electrodes and supporting the second substrate.

It is an advantage over the prior art that the plasma panel of the present invention utilizes the conductive spacers for separating the first substrate from the second substrate and performing the discharge of opposed electrodes. The discharge efficiency of the plasma panel is thereby enhanced.

These and other objects of the present invention will be apparent to those of ordinary skill in the art after having read the following detailed description of the preferred embodiment that is illustrated in the various figures and drawings.

DETAILED DESCRIPTION

Figure 1:
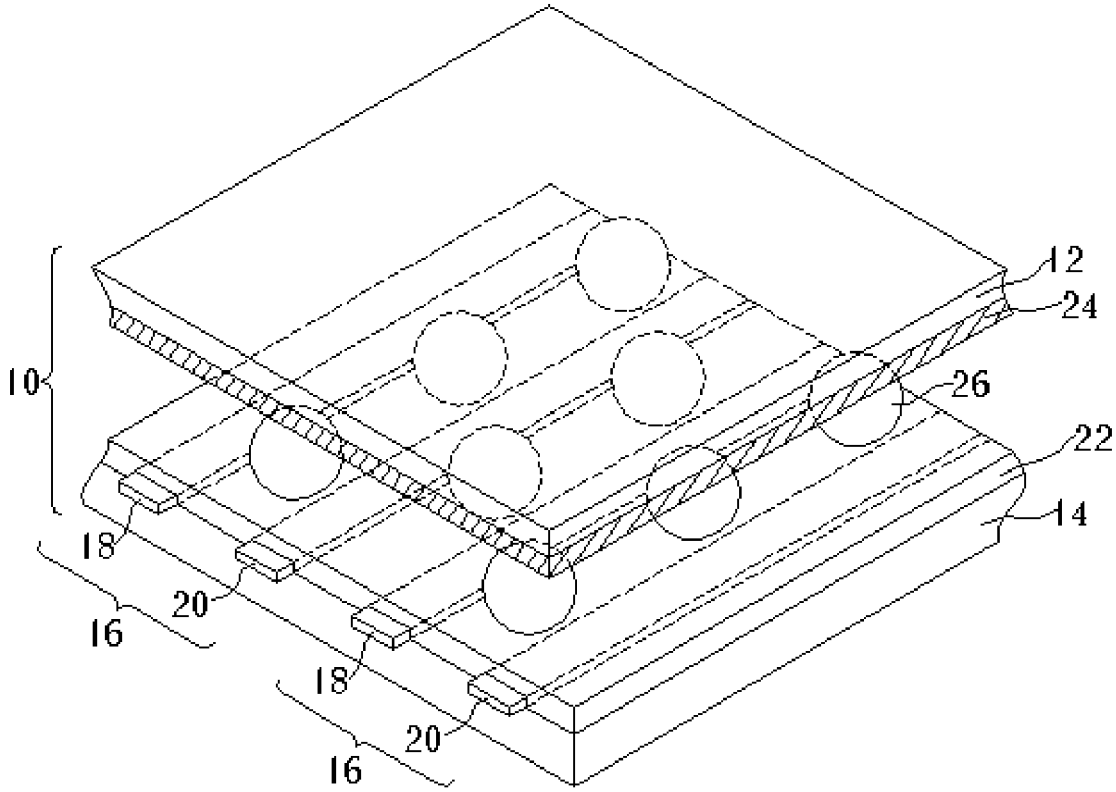
Fig. 1 Prior art
FIG. 1 is a perspective view of a prior art plasma panel.
Figure 2:
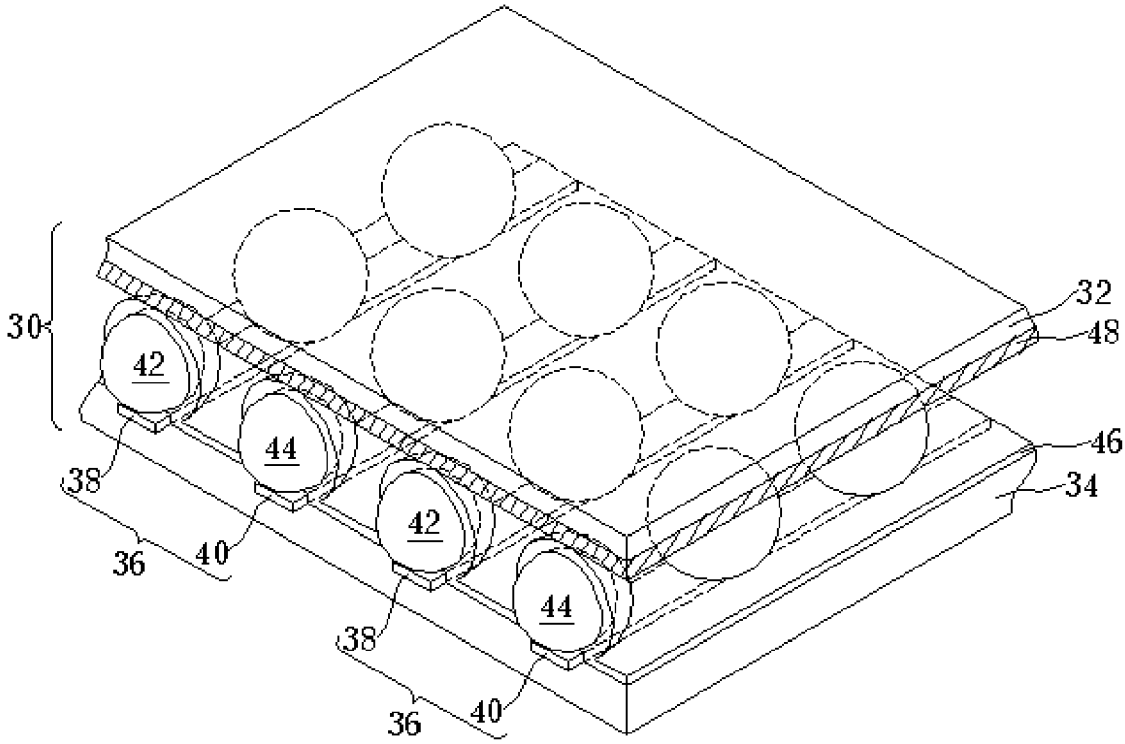
FIG. 2 is a perspective view of a plasma panel according to the first embodiment of the present invention.
Figure 3:
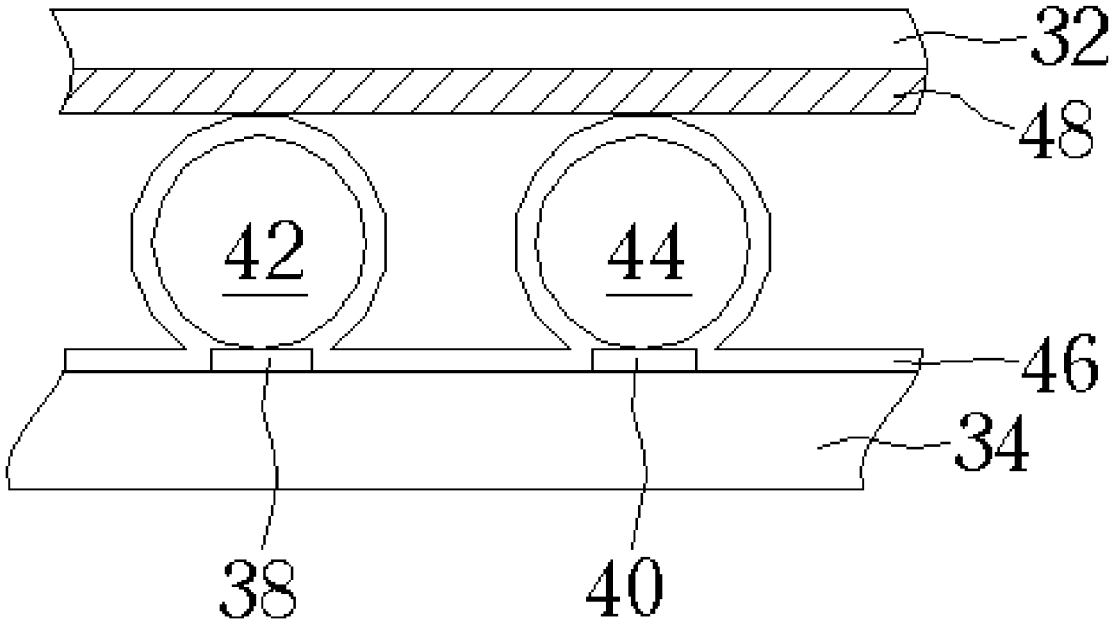
FIG. 3 is a front side view illustrating the plasma panel shown in FIG. 2.
Figure 4:
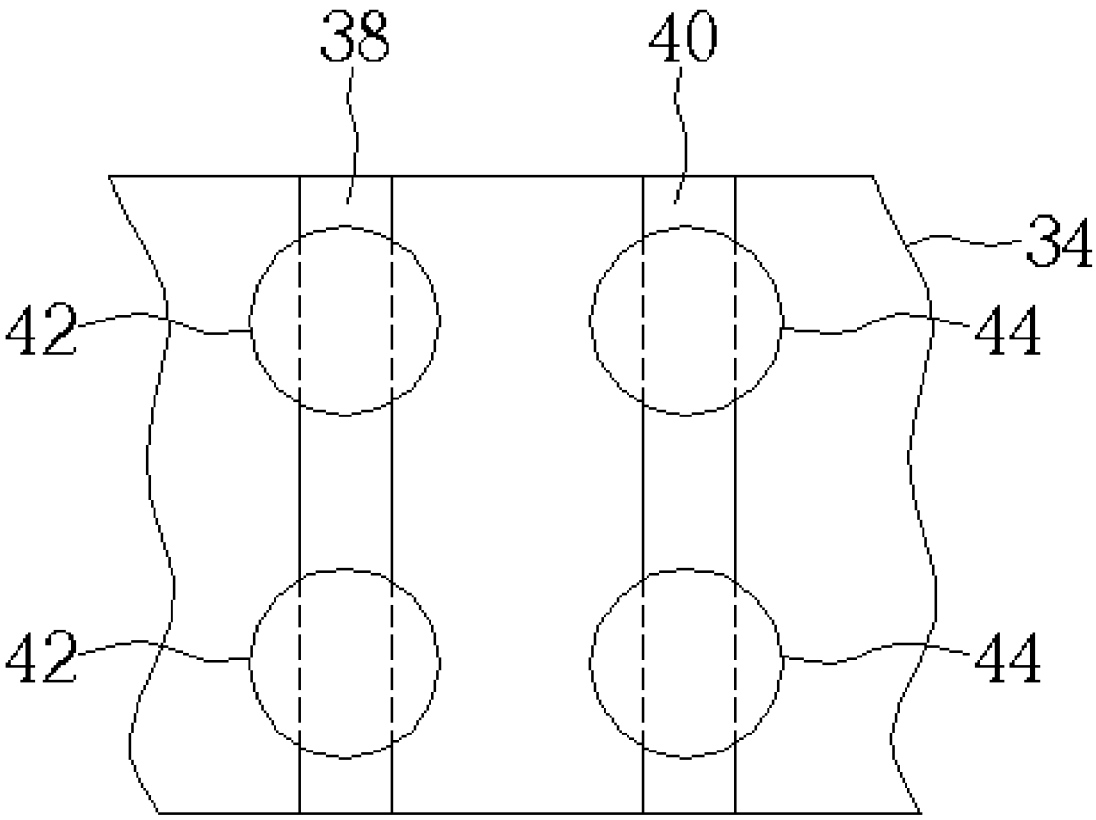
FIG. 4 is a top view illustrating a rear substrate of the plasma panel shown in FIG. 2.

Referring to FIGS. 2-4. FIG. 2 is a perspective view of a plasma panel according to the first embodiment of the present invention. FIG. 3 is a front side view illustrating the plasma panel shown in FIG. 2. FIG. 4 is a top view illustrating a rear substrate of the plasma panel shown in FIG. 2. As shown in FIGS. 2 and 3, a plasma panel 30 comprises a front substrate 32, a rear substrate 34 parallel and opposite to the front substrate 32, and a discharge gas sealed between the front substrate 32 and the rear substrate 34. Additionally, the plasma panel 30 further includes a plurality of parallel electrode pairs 36 located on an upper surface of the rear substrate 34, a plurality of conductive spacers 42 and 44 electrically connected to the electrode pairs 36, a dielectric layer 46 deposited on the electrode pairs 36, and a phosphorous layer 48 formed on a lower surface of the front substrate 32. The plasma panel 30 further includes a reflective layer (not shown) deposited on the dielectric layer 46 and a phosphorous layer (not shown) formed on the reflective layer.

As shown in FIG. 4, each of the electrode pairs 36 includes an electrode 38 having a plurality of conductive spacers 42 formed thereon and an electrode 40 having a plurality of conductive spacers 44 formed thereon. Furthermore, the conductive spacers 42 are respectively opposed to the conductive spacers 44, and a distance between two adjacent conductive spacers 42 (or two adjacent conductive spacers 44) can be adjusted according to a process limitation or a requirement of the discharge efficiency. In the present embodiment, each of the conductive spacers 42 and 44 comprises a spherical structure or a polygonal structure for separating the front substrate 32 from the rear substrate 34. Owing to the conductive spacers 42 and 44, a gap between the front substrate 32 and the rear substrate 34 is larger than 10 μm for providing a sufficient discharge space for the discharge gas. Moreover, there are two kinds of methods for connecting the conductive spacers 42 and 44 to the electrodes 38 and 40. The first kind of method is to form a conductive adhesion layer, such as conductive silver glue, onto each of the conductive spacers 42 and 44. Then, the conductive spacers 42 and 44 are adhered to the electrodes 38 and 40 by operators or machines. The second kind of method is to form a plurality of sites on the electrodes 38, 40 or form a plurality of openings in the dielectric layer 46. The sites and the openings are positioned above the electrodes 38, 40 and allow the conductive spacers 42, 44 to contact with the electrodes 38, 40. Then, operators or machines put the conductive spacers 42 and 44 into the sites or the openings. Finally, the conductive spacers 42 and 44 are electrically connected to the electrodes 38 and 40 through a packaging process. In the first embodiment, each of the electrodes 38 and 40 comprises chromium/copper/chromium (Cr/Cu/Cr), aluminum (Al), silver (Ag), or chromium/aluminum/chromium (Cr/Ag/Cr). Each of the conductive spacers 42 and 44 comprises stainless steel, and the discharge gas comprises an inert gas such as neon (Ne), xenon (Xe), or a mixture of neon and xenon.

Noticeably, since the conductive electrodes 42 and 44 are electrically connected to the electrodes 38 and 40, the conductive electrodes 42 and 44 are regarded as extension parts of the electrodes 38 and 40 for enhancing the discharge between the electrodes 38 and 40. In other words, as a discharge voltage is applied to the electrodes 38 and 40 through a driving circuit for producing a surface discharge between the electrodes 38 and 40, the discharge voltage causes the conductive spacers 42 and 44 to generate a discharge of opposed electrodes for igniting plasma, which irradiates ultraviolet rays to make the phosphorous layer 48 emit visible light.

Figure 5:
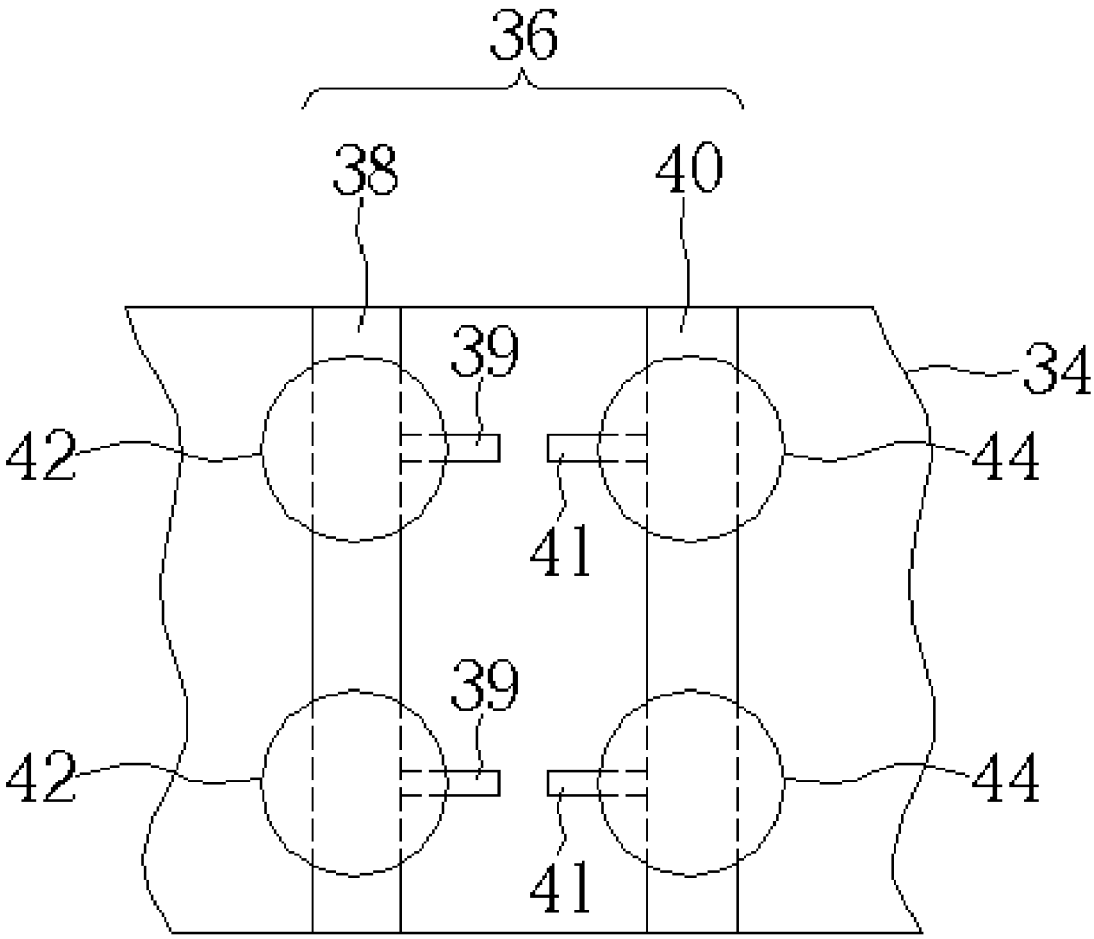
FIG. 5 is a top view illustrating a rear substrate of a plasma panel according to the second embodiment of the present invention.

It should be noted that the rear substrate of the present invention is not limited to that shown in FIG. 4 and other structures of the rear substrate are described as follows. Referring to FIG. 5. FIG. 5 is a top view illustrating a rear substrate of a plasma panel according to the second embodiment of the present invention. As shown in FIG. 5, the rear substrate 34 has a plurality of parallel electrode pairs 36 positioned thereon, each of which includes an electrode 38 having a plurality of protrusions 39 and an electrode 40 having a plurality of protrusions 41. The protrusions 39 are respectively opposed to the protrusions 41 for igniting plasma. In addition, a plurality of conductive spacers 42 is formed on the electrode 38, while a plurality of conductive spacers 44 is formed on the electrode 40. Each of the conductive spacers 42 and 44 comprises a spherical structure or a polygonal structure for performing the discharge of opposed electrodes and supporting the front substrate. As shown in FIG. 5, the conductive spacers 42 and 44 are respectively positioned over the protrusions 39 and 41, but that is not necessary. The positions of the conductive spacers 42 and 44 can be adjusted according to a process limitation or a requirement of the discharge efficiency.

In the second embodiment, as a discharge voltage is applied to the electrode 38 and the electrode 40, the plasma is firstly ignited between the protrusions 39 and 41 via the discharge voltage. Then, the discharge of opposed electrodes is induced between the conductive spacers 42 and 44 for igniting the whole plasma. The discharge gaps between the protrusions 39 and 41 are small enough that a firing voltage for igniting plasma between the protrusions 39 and 41 is lowered. That is to say, a lower discharge voltage can be applied to the electrode 38 and the electrode 40 for igniting the plasma between the protrusions 39 and 41 in the present embodiment. Accordingly, not only the surface discharge is generated between the protrusions 39 and 41, but also the discharge of opposed electrodes is generated between the conductive spacers 42 and 44, thereby increasing the discharge efficiency. As a result, the present embodiment has the advantage of including both the surface discharge and the discharge of opposed electrodes, lowering a firing voltage of the plasma, and enhancing the discharge efficiency.

Figure 6:
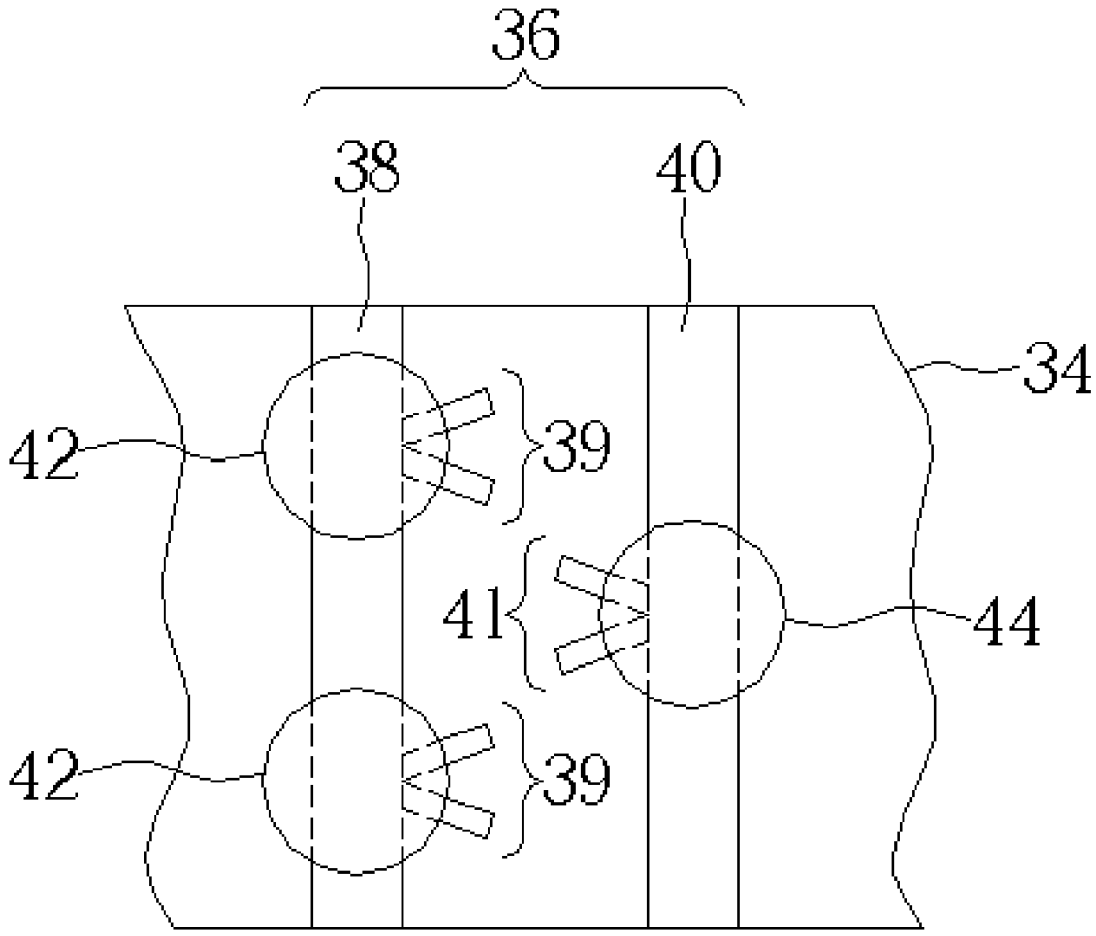
FIG. 6 is a top view illustrating a rear substrate of a plasma panel according to the third embodiment of the present invention.

Referring to FIG. 6. FIG. 6 is a top view illustrating a rear substrate of a plasma panel according to the third embodiment of the present invention. As shown in FIG. 6, the rear substrate 34 has a plurality of parallel electrode pairs 36 positioned thereon, each of which includes an electrode 38 having a plurality of protrusions 39 and an electrode 40 having a plurality of protrusions 41. The protrusions 39 and 41 function to reduce a firing voltage of the plasma. In addition, each of the protrusions 39 and 41 is a V-shaped structure and each of the protrusions 41 is positioned between two adjacent protrusions 39. Thus, each of the protrusions 41 is opposed to two adjacent protrusions 39, and each of the protrusions 39 is opposed to two adjacent protrusions 41. Furthermore, a plurality of conductive spacers 42 is formed on the electrode 38, and a plurality of conductive spacers 44 is formed on the electrode 40. Each of the conductive spacers 42 and 44 comprises a spherical structure or a polygonal structure for performing a discharge of opposed electrodes and supporting the front substrate. As shown in FIG. 6, the conductive spacers 42 and 44 are respectively positioned over the protrusions 39 and 41, but that is not necessary. The positions of the conductive spacers 42 and 44 can be adjusted according to a process limitation or a requirement of the discharge efficiency.

Figure 7:
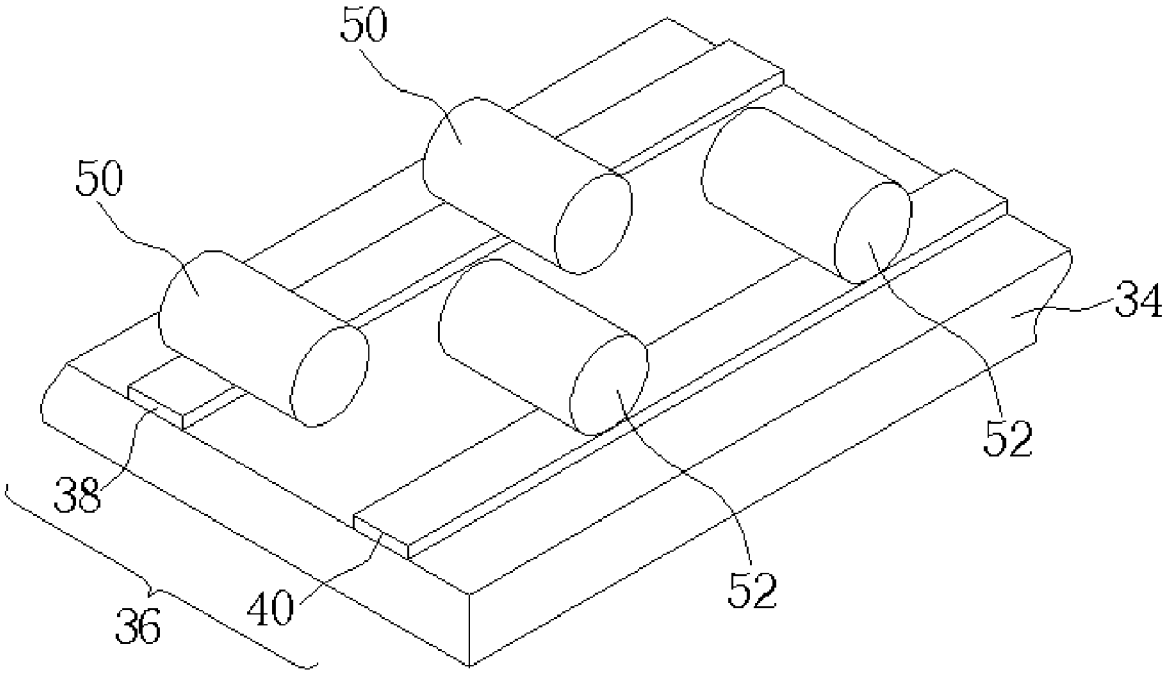
FIG. 7 is a top view illustrating a rear substrate of a plasma panel according to the fourth embodiment of the present invention.

Referring to FIG. 7. FIG. 7 is a top view illustrating a rear substrate of a plasma panel according to the fourth embodiment of the present invention. As shown in FIG. 7, the rear substrate 34 has a plurality of parallel electrode pairs 36 positioned thereon, each of which includes an electrode 38 and an electrode 40. Additionally, a plurality of conductive spacers 50 is formed on the electrode 38, and a plurality of conductive spacers 52 is formed on the electrode 40. Each of the conductive spacers 50 and 52 comprises a bar-like structure having a round cross-section or a multilateral cross-section. The conductive spacers 50 are arranged in parallel and interlaced with the conductive spacers 52 for performing a discharge of opposed electrodes and supporting the front substrate.

Figure 8:
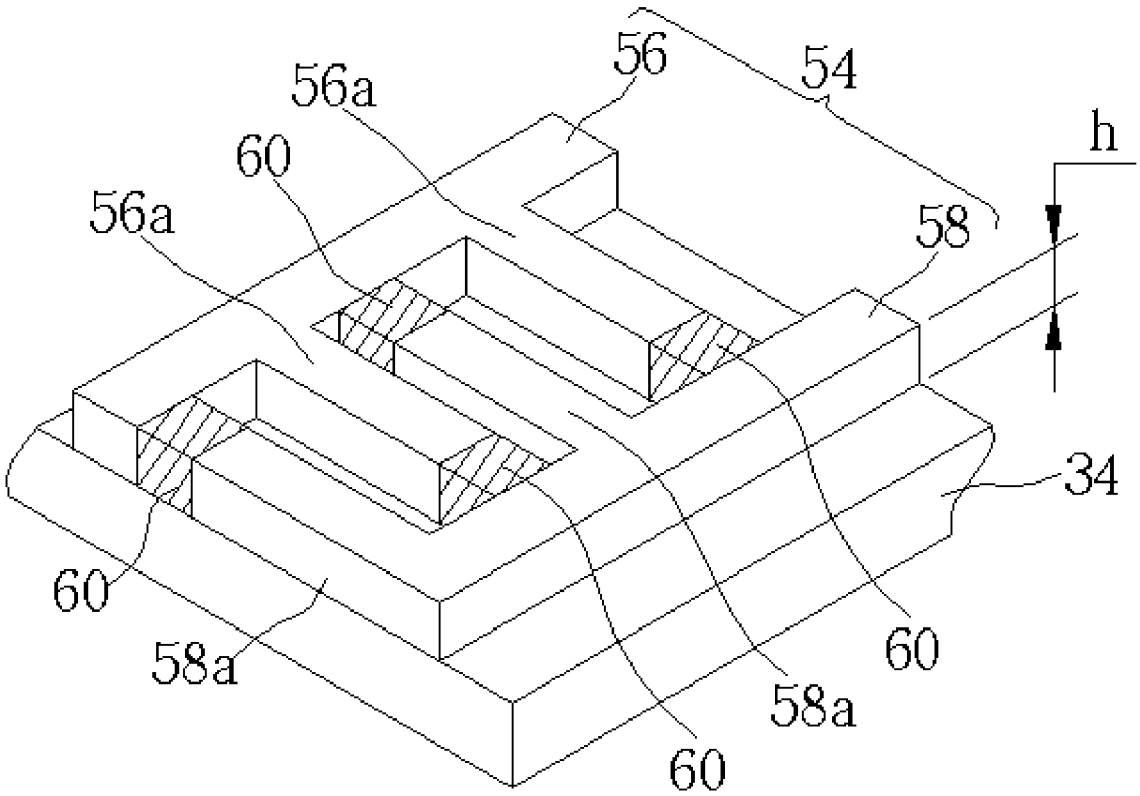
FIG. 8 is a top view illustrating a rear substrate of a plasma panel according to the fifth embodiment of the present invention.

Referring to FIG. 8. FIG. 8 is a top view illustrating a rear substrate of a plasma panel according to the fifth embodiment of the present invention. As shown in FIG. 8, the rear substrate 34 has an electrode pair 54 located thereon, which has a thickness h larger than 10 μm and is used for performing a discharge of opposed electrodes and supporting the front substrate. Additionally, the electrode pair 54 includes an electrode 56 having a plurality of protrusions **56*a* and an electrode 58 having a plurality of protrusions 58*a*. The protrusions 56*a* are arranged in parallel and interlaced with the protrusions 58*a*. The electrode pair 54 further comprises a plurality of insulating layers 60 for connecting the protrusions 56*a* to the electrode 58 and for connecting the protrusions 58*a* to the electrode 56. However, the insulating layers 60 are not necessary elements and they also can be omitted. In the fifth embodiment, the electrode 56 and the electrode 58 both comprise electrode modules. The electrode 56 and the electrode 58 can be the same electrode modules or different electrode modules. Noticeably, since the electrode pair 54** functions to perform the discharge of opposed electrodes as well as support the front substrate, the spacers are therefore omitted in this embodiment. Thereby, the fifth embodiment of the present invention has the advantage of increasing discharge efficiency as well as reducing process steps.

In comparison with the prior art, the plasma panel of the present invention utilizes the conductive spacers 42 and 44 or the conductive spacers 50 and 52 for separating the front substrate 32 from the rear substrate 34. The discharge of opposed electrodes is generated between the conductive spacers 42 and 44 or between the conductive spacers 50 and 52, so that the discharge efficiency of the plasma panel is enhanced. Furthermore, the electrodes 38 and 40 include a plurality of protrusions 39 and 41, and therefore, discharge gaps between the protrusions 39 and 41 are small enough to lower the firing voltage of the plasma, thereby increasing the discharge efficiency. Additionally, the electrode pair 54 functions to perform the discharge of opposed electrodes and separate the front substrate 32 from the rear substrate 34, which results in reducing process steps and improving the discharge efficiency.

Those skilled in the art will readily observe that numerous modifications and alterations of the device may be made while retaining the teachings of the invention. Accordingly, the above disclosure should be construed as limited only by the metes and bound of the appended claims.

What is claimed is:

1. A plasma panel functioning as a light source of a display device comprising:

a first substrate;

a second substrate positioned above the first substrate, a distance between the first substrate and the second substrate being larger than ten micrometers; and at least an electrode pair having only a first electrode and a second electrode extending along a first direction on the first substrate, wherein the first electrode and the second electrode of the electrode pair perform discharge to each other and support the second substrate.

2. The plasma panel of claim 1 wherein each of the first electrode and the second electrode comprises a bar-like structure.

3. The plasma panel of claim 2 wherein the first electrode comprises a plurality of parallel first protrusions.

4. The plasma panel of claim 3 wherein the second electrode comprises a plurality of second protrusions that are arranged in parallel and interlaced with the first protrusions.

5. The plasma panel of claim 2 wherein the first electrode comprises a plurality of first conductive spacers for performing a discharge of opposed electrodes and supporting the second substrate.

6. The plasma panel of claim 5 wherein the second electrode comprises a plurality of second conductive spacers for performing a discharge of opposed electrodes and supporting the second substrate.

7. The plasma panel of claim 6 wherein each of the first conductive spacers and the second conductive spacers comprises a spherical structure or a polygonal structure.

8. The plasma panel of claim 6 wherein each of the first conductive spacers and the second conductive spacers comprises a bar-like structure having a round cross-section or a multilateral cross-section.

9. The plasma panel of claim 8 wherein the first conductive spacers are arranged in parallel and interlaced with the second conductive spacers.

10. The plasma panel of claim 6 wherein the first electrode further comprises a plurality of first protrusions.

11. The plasma panel of claim 10 wherein the second electrode further comprises a plurality of second protrusions, which are respectively opposite to the first protrusions.

12. The plasma panel of claim 11 wherein each of the first protrusions and the second protrusions comprises a belt-like structure.

13. The plasma panel of claim 11 wherein each of the first protrusions and the second protrusions comprises a V-shaped structure.

14. The plasma panel of claim 1 wherein the display device comprises a liquid crystal display device.

* * * * *